US009091479B2

(12) United States Patent
Miedema et al.

(10) Patent No.: US 9,091,479 B2
(45) Date of Patent: Jul. 28, 2015

(54) DRYER APPARATUS

(75) Inventors: Randy Miedema, Zeeland, MI (US); Kurt Palmbos, Zeeland, MI (US)

(73) Assignee: Lakewood Process Machinery, Holland, MI (US)

( * ) Notice: Subject to any disclaimer, the term of this patent is extended or adjusted under 35 U.S.C. 154(b) by 0 days.

(21) Appl. No.: 13/549,085

(22) Filed: Jul. 13, 2012

(65) Prior Publication Data

US 2014/0013615 A1 Jan. 16, 2014

(51) Int. Cl.
*F26B 3/00* (2006.01)
*F26B 25/08* (2006.01)

(52) U.S. Cl.
CPC ..... *F26B 25/08* (2013.01)

(58) Field of Classification Search
CPC ..... F26B 19/005; F26B 17/045; F26B 17/04; F26B 17/122; F26B 17/08; B65G 15/30; B65G 15/60; B65G 23/44; A23B 7/0205
USPC ..... 34/487, 502, 216, 401, 483; 432/14
See application file for complete search history.

(56) References Cited

U.S. PATENT DOCUMENTS 2,575,426 A * 11/1951 Parnell ..... 426/241
2,899,189 A * 8/1959 Matis et. al. ..... 432/47
4,256,029 A * 3/1981 Steffen et al. ..... 454/182
5,913,590 A * 6/1999 Backus ..... 34/401

* cited by examiner

*Primary Examiner* — Kenneth Rinehart
*Assistant Examiner* — Jason Lau
(74) *Attorney, Agent, or Firm* — The Watson I.P. Group, PLC; Jovan N. Jovanovic; Vladan M. Vasiljevic

(57) ABSTRACT

An apparatus for drying produce and small parts or pieces utilizing a fluid flow, typically air, through passages in a treatment member, and that is well suited for use in association with the drying of small fruit (i.e. blueberry, strawberry, blackberry, etc.). The dryer apparatus includes a frame, a treatment member, and a fluid supply member. The treatment member holds the items while the fluid supply member directs fluid through the treatment member and into contact with the small parts or pieces. The treatment member may be a flexible belt which is passed along a plurality of rollers. Advantageously, the fluid supply member can be controlled so that the small parts or pieces rotate or lift off the treatment member thereby exposing multiple surfaces thereof to the fluid.

9 Claims, 5 Drawing Sheets

DRYER APPARATUS

BACKGROUND OF THE DISCLOSURE

1. Field of the Disclosure

The disclosure relates in general to a dryer apparatus, and more particularly, to a dryer apparatus for drying produce which is utilized typically downstream of a food product processing line. While not limited thereto, typically such an apparatus is utilized in association with small fruit (i.e. blueberry, strawberry, blackberry, etc.) cleaning and packaging apparatus. The disclosure is not limited to use in association with food processing, but may also be used in small parts washing and cleaning, baked food air cooling, chaff removal, or small particulate, dirt, and/or dust removal from small parts or food products.

2. Background Art

The use of air (or other fluids) to dry and/or disinfect food products, after water washing, is known in the art. Current processes include blowing of forced air directly downward onto a table of produce similar to a blower at a car wash. Such processes tend to damage certain produce if the force of the air is too great, and the produce is pushed against the table by the force of the air. In other situations, the processes do not reach many of the areas of the produce, leaving some surfaces dry, while other surfaces remain wet.

Other processes, while they may be effective at getting rid of the moisture, such process tend to be wasteful and messy with produce often blown off of the treatment table and onto the floor. Still other processes may not suitable for food produce; these include heating, using a dryer machine, tumbling, or waiting for the water to evaporate naturally.

SUMMARY OF THE DISCLOSURE

The disclosure is directed to a dryer apparatus for drying a plurality of small items. The dryer apparatus comprises a frame assembly, a treatment member and a fluid supply member. The frame assembly is associable with an outside structure or surface (i.e., as another piece of equipment either upstream or downstream, or on a facility floor). The frame defines a cavity having an inlet and an outlet opening. The treatment member is coupled to the frame, and at least a portion of which extends over the outlet opening. The treatment member has a first end and a second end, and, a treatment portion. The treatment portion has a top surface, a bottom surface, and, a plurality of passage openings that extend therethrough placing the top surface and the bottom surface in fluid communication. The passage openings having a size, wherein the size precludes passage of a small item therethrough. The fluid supply member is associated with the inlet of the frame. The fluid supply member directs a fluid into the cavity of the frame assembly and toward the outlet opening, and into contact with the bottom surface of the treatment portion of the treatment member and, in turn, through the passage openings.

In a preferred embodiment, the treatment member is translatable relative to the frame.

In another preferred embodiment, the treatment member comprises a plurality of rollers rotatably coupled to the frame and a flexible belt extending therebetween. A portion of the flexible belt has a plurality of openings extending therethrough that extends over the outlet opening defining the treatment portion of the flexible belt. The remainder of the flexible belt defining a return portion.

In another preferred embodiment, the plurality of rollers extend about the cavity of frame assembly.

In another preferred embodiment, at least one of the plurality of rollers interfaces with the top surface of the flexible belt. Additionally, at least one of the plurality of rollers interfaces with the bottom surface of the flexible belt.

In another preferred embodiment, the flexible belt comprises a plurality of substantially rigid links that are rotatably coupled together.

In another preferred embodiment, the frame further includes a pair of opposing walls, and a spanning wall that extends about a portion of a perimeter of the pair of opposing walls therebetween to define the cavity. A portion of the perimeter which is not spanned by the opposing walls defining the outlet opening.

In another preferred embodiment, at least one of the pair of opposing walls further includes a wall opening. The fluid supply member further comprises a blower positioned in fluid communication with the wall opening.

In another preferred embodiment, each of the pair of opposing walls further includes a wall opening. The fluid supply member further includes a blower that is positioned in fluid communication with the wall opening of each of the pair of opposing walls.

In yet another preferred embodiment, the opposing walls are substantially mirror images of each other.

In a preferred embodiment, the fluid supply member further comprises a blower motor that includes a blower fan control configured to control the speed of the blower motor.

In an preferred embodiment, the blower fan control allows the blower motor speed to be adjustable.

In another aspect of the disclosure, the disclosure is directed to a method of drying small parts or pieces comprising the steps of: (a) providing a frame assembly having an outlet opening, with a fluid supply member directing fluid at the outlet opening; (b) placing a treatment member having a top surface, a bottom surface and a plurality of openings extending therethrough in operable orientation with the outlet opening to, in turn, direct fluid through the plurality of openings of the treatment table; (c) activating the fluid supply member to direct a fluid through the outlet opening to the plurality of openings of the treatment member; (d) placing a plurality of small pieces or parts on the top surface of the treatment member; and (e) controlling the fluid supply member to provide sufficient fluid through the plurality of openings of the treatment member to effectuate at least one of lifting off of at least some of the pieces or parts on the top surface of the treatment member and rolling of at least some of the pieces or parts on the top surface of the treatment member.

In a preferred embodiment, the treatment member comprises a flexible belt having a treatment portion that extends over the outlet opening. A plurality of rollers are configured around the frame to guide the flexible belt therearound. In such an embodiment, the method further comprises the steps of: activating at least one of the plurality of rollers to move the flexible belt along the outlet opening.

In another preferred embodiment, the pieces or parts lift off the surface between ½ inch and 4 inches.

BRIEF DESCRIPTION OF THE DRAWINGS

The disclosure will now be described with reference to the drawings wherein.

DETAILED DESCRIPTION OF THE DISCLOSURE

Figure 1:
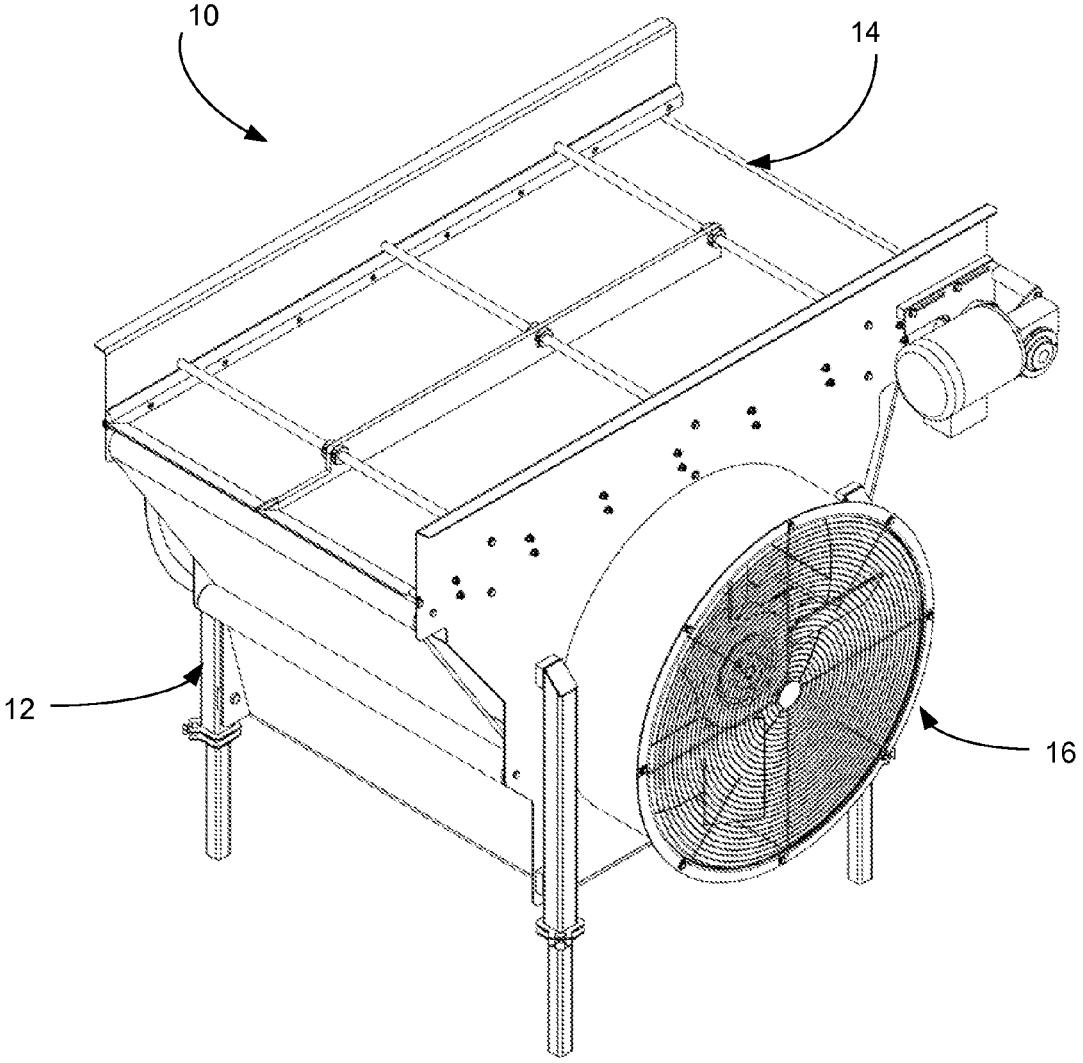
FIG. 1 of the drawings is an perspective view of a dryer apparatus of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

With reference to FIG. 1, the dryer apparatus is shown generally at 10. The dryer apparatus 10 of the present disclosure includes frame assembly 12, treatment member 14 and fluid supply member 16. The dryer apparatus 10 of the present invention is typically utilized in association with the drying of small products or pieces, such as produce, and more preferably, small fruit (blueberry, strawberry, blackberry, etc.). Of course, the dryer apparatus 10 can be utilized to dry other small items, such as small parts and the like. Typically, the fluid supply 16 will provide for the movement of the small members (i.e., rolling, bouncing, etc.) so that multiple surfaces are directly exposed to the fluid that is passing therethrough. Generally, the fluid comprises air, while other gasses, vapors and combinations are likewise contemplated.

Figure 5:
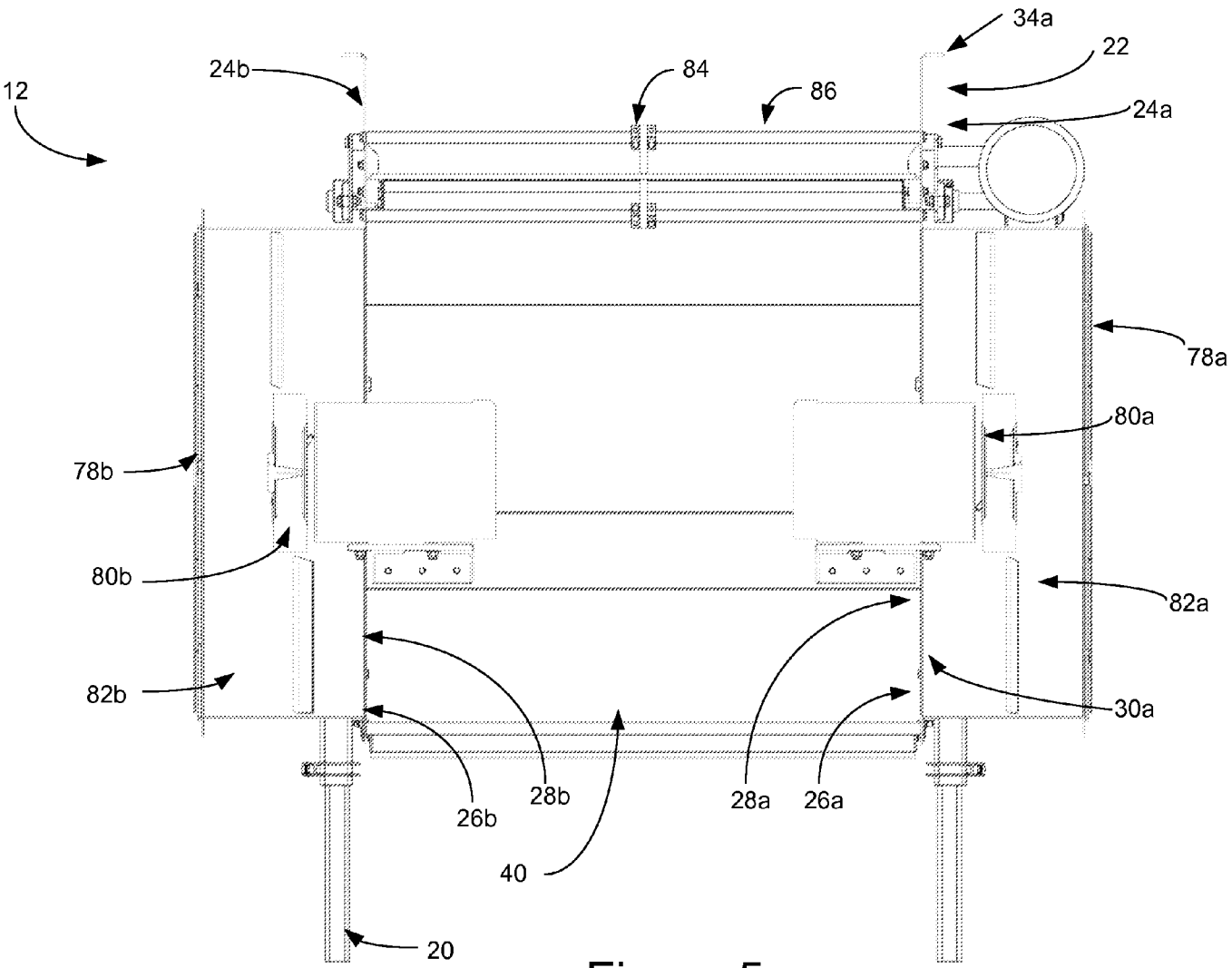
FIG. 5 of the drawings is a cross-sectional view of the dryer apparatus of the present disclosure, taken generally about lines 5-5 of FIG. 2.

With reference to FIG. 5, the frame assembly 12 is shown as comprising a plurality of legs 20 and a wall structure 22. The wall structure 22 includes opposing walls 24*a*, 24*b*, and a spanning wall 40. The opposing walls 24*a*, 24*b* and the spanning wall 40 together define cavity 44 which has at least one outlet opening 46. The outlet opening 46 in the present embodiment comprises a substantially planar vertical opening which has a generally rectangular configuration.

Figure 3:
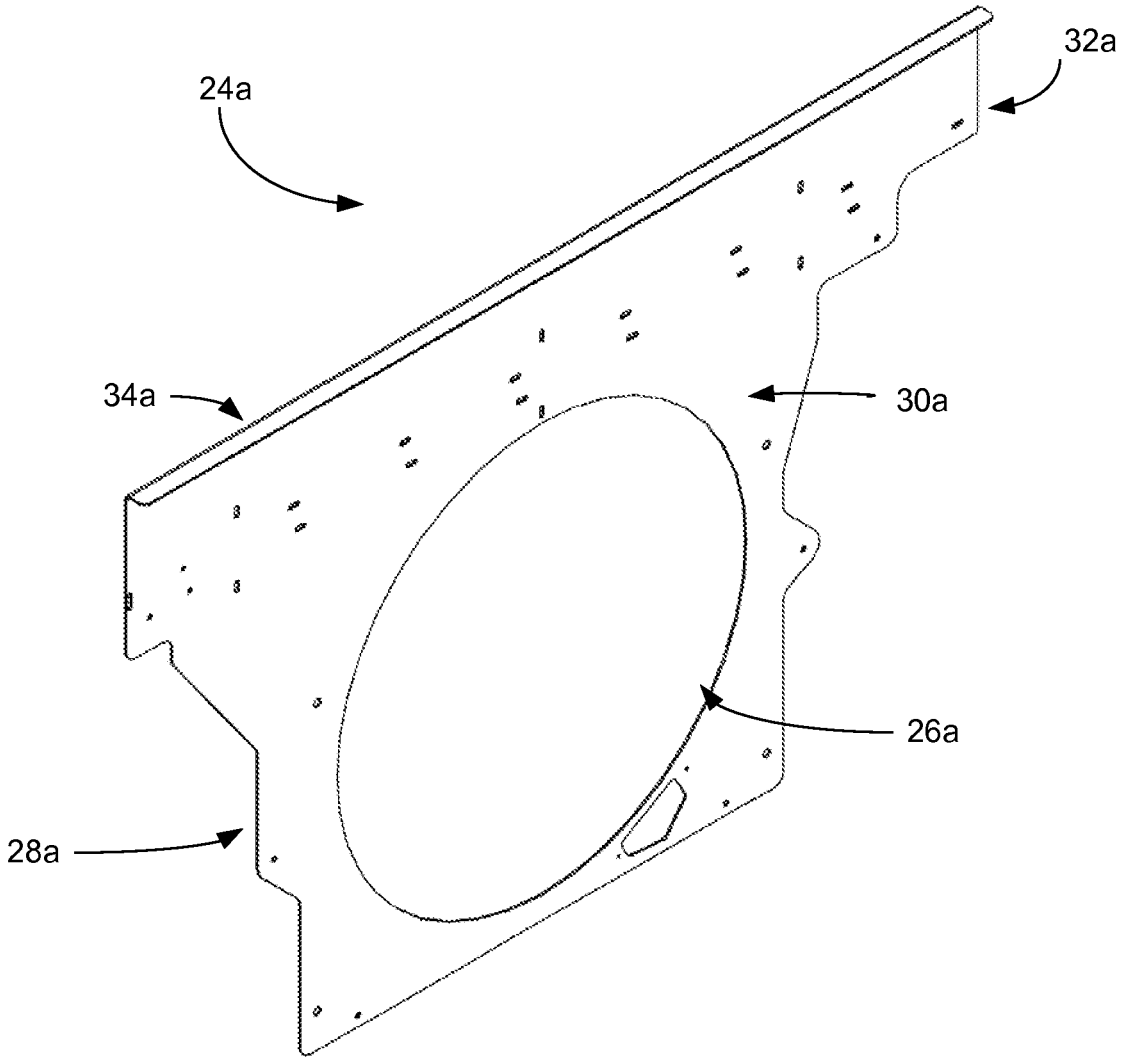
FIG. 3 of the drawings is a perspective view of an opposing wall of the dryer apparatus of the present disclosure.
Figure 4:
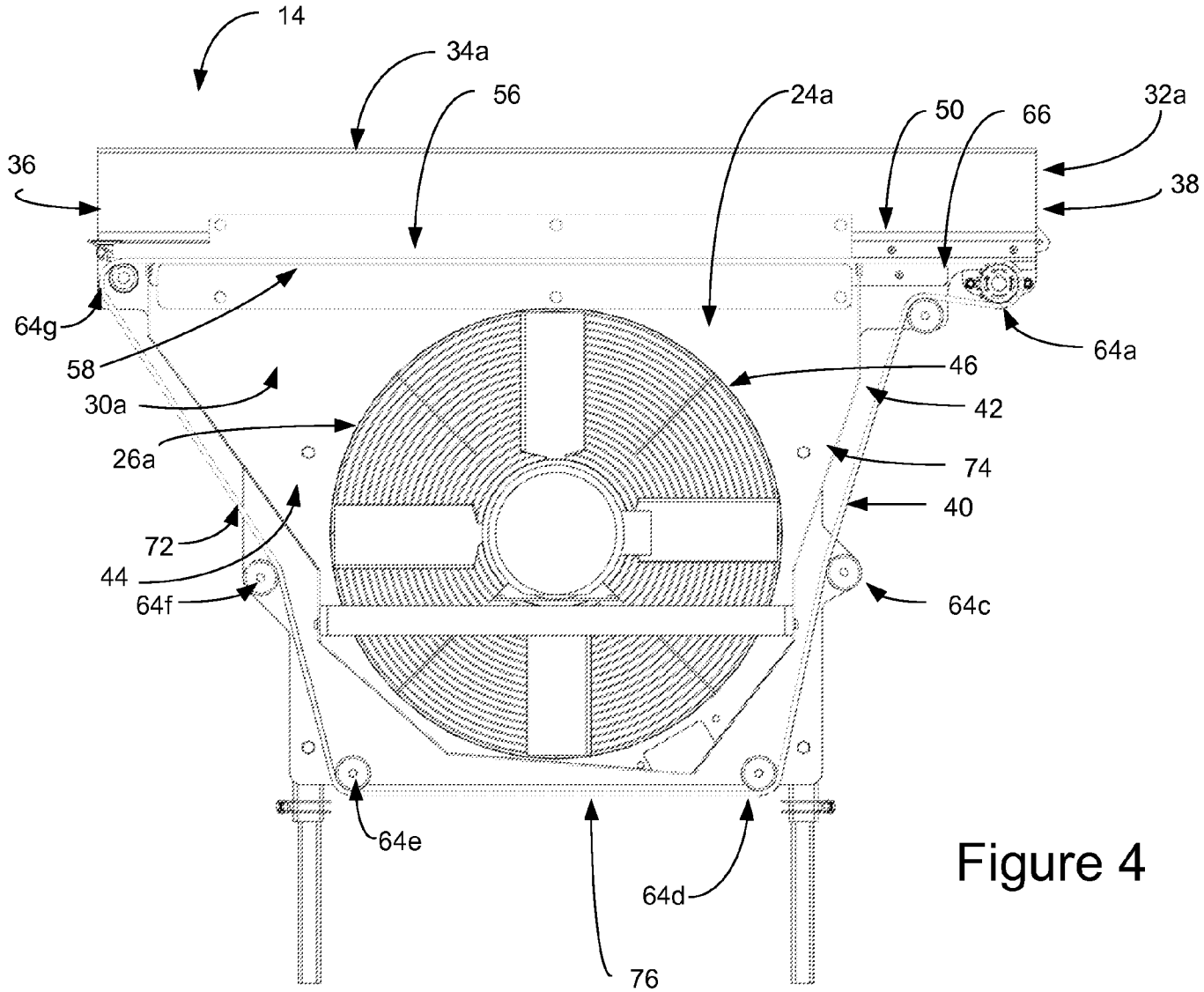
FIG. 4 of the drawings is a cross-sectional view of the dryer apparatus of the present disclosure, taken generally about lines 4-4 of FIG. 2.

The opposing walls 24*a*, 24*b* are shown in FIGS. 3 & 4 as being substantially mirror images of each other (although not required). As such, opposing wall 24*a* will be described in detail with the understanding that opposing wall 24*b* comprises a mirror image thereof. Identical reference numbers will be utilized for identical structures on the opposing walls, with the reference numbers of the first wall being augmented by an "a" and with the reference numbers of the second wall being augmented by a "b". Opposing wall 24*a* as comprising wall opening 26*a*, inside surface 28*a*, and outside surface 30*a*. The two surfaces cooperate to define outer perimeter 32*a* and further define upper edge 34*a*. The opening 26*a* extends through the opposing wall 24*a*, and in the embodiment shown, comprises a generally uniformly circular opening that is spaced apart from the outer perimeter 32*a*. Generally, the opposing wall 24*a* comprises a sheet metal material which is generally substantially uniform and planar. Openings and surface variations (i.e., flanges and the like) can be introduced for purposes of assembly and/or for structural rigidity. For each embodiment, the opposing walls 24*a*, 24*b*, in association with the treatment member 14 and the spanning wall 40, shall define an interior cavity 44.

While the opposing walls 24*a* and 24*b* are shown to be substantial mirror images of each other, it will be understood that in some embodiments, the two walls may have a different configuration. For example, the opposing walls may be such that only one of the two walls includes an opening (such as opening 26*a*). In other embodiments, the opening size and location can be varied between the two walls 24*a*, 24*b*. In still other embodiments, there may be some dimensional variations between the two opposing walls 24*a*, 24*b*.

The spanning wall 40 is shown in FIGS. 4 & 5 collectively, as comprising a plurality of segments, such as segment 42. In the embodiment shown, the spanning wall generally follows and spans between the outer perimeter 32*a* and the outer perimeter 32*b* of the opposing walls 24*a*, 24*b*, from a first terminating edge 36 to a second terminating edge 38. As set forth above, the spanning wall 40 in cooperation with the opposing walls 24*a*, 24*b* together define cavity 44 and outlet opening 46. The spanning wall 40 may be constructed from a monolithic sheet of material (i.e., metal, plastic or the like) wherein it is bent so as to better follow the outer perimeter of the opposing walls 24*a*, 24*b* thereby forming a plurality of different segments 42. In other embodiments, the spanning wall 40 can have a different configuration which is more continuous and less segment-like. In still other embodiments, the spanning wall 40 may be formed from a plurality of separate members which can be joined together or which can be separate from each other and joined to the opposing walls 24*a*, 24*b*.

With reference to FIG. 5, the frame assembly 12 generally defines a cavity 44 which has a generally increasing cross-sectional area terminating at the outlet opening 46, generally defined by upper edges 42*a*, 42*b* and first terminating edge 36 and second terminating edge 38. The opposing walls 24*a*, 24*b* are generally parallel to each other, and the spanning wall 40 is generally perpendicular to the opposing walls 24*a*, 24*b*.

Figure 2:
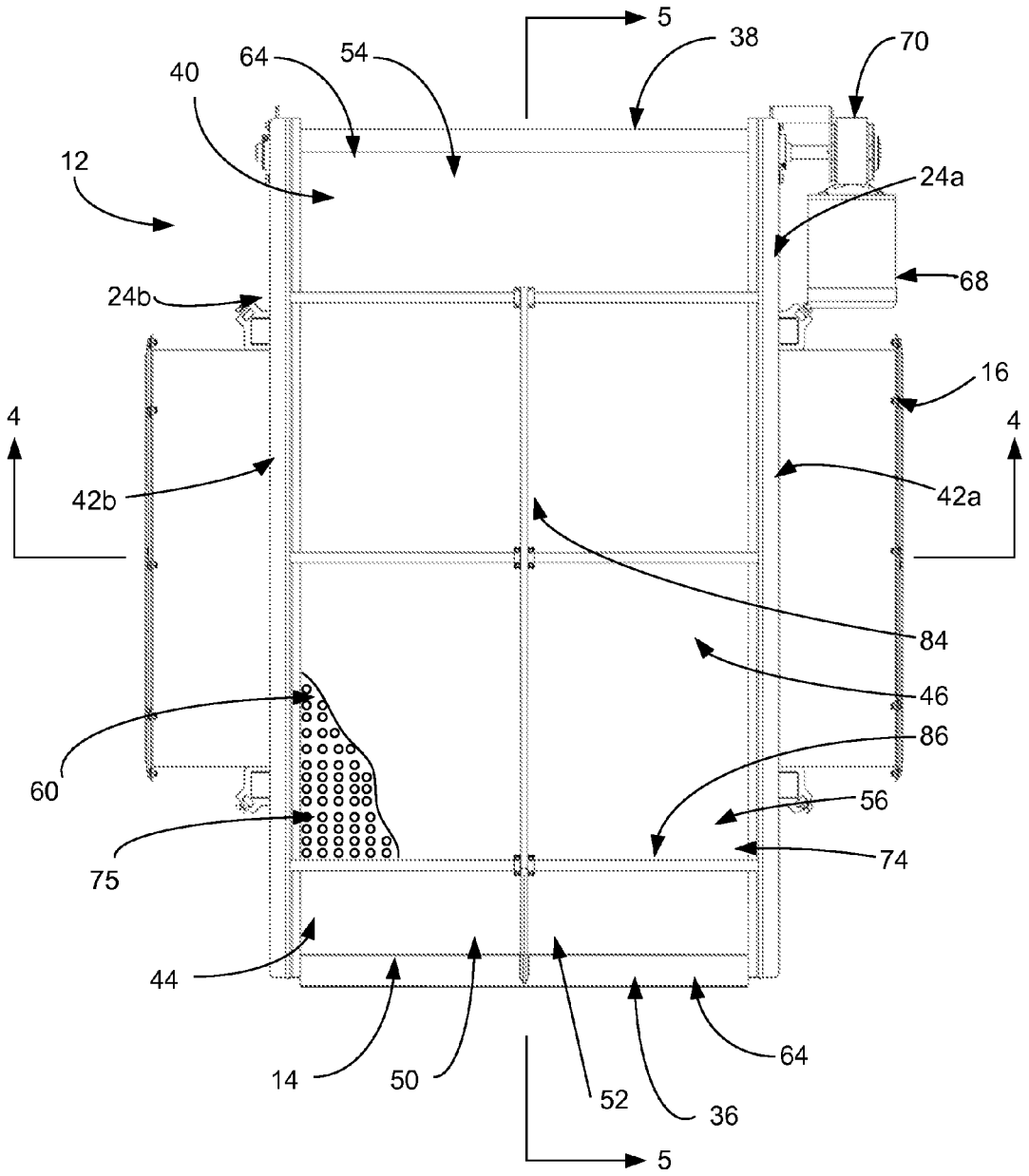
FIG. 2 of the drawings is a top plan view of the dryer apparatus of the present disclosure.

As shown in FIGS. 2 & 5, a plurality of cross rods 86 are fixably attached to each opposing wall 24*a*, 24*b*. A belt guide 84 is attached to the cross rods 86 slightly above the top surface 56 of the flexible belt 72 to limit vertical movement of the belt 74 during operation.

The treatment member 14, shown in FIGS. 2 and 4, as comprising flexible belt 72 and a plurality of rollers 62 that facilitate movement of the flexible belt 72 across the outlet opening 46. The flexible belt 72 includes a top surface 56, a bottom surface 58 and a plurality of passage openings 60. In one embodiment, the flexible belt 72 may comprise a modular plastic belt which is formed of a number of plastic modules that are pivotally joined to each other. A number of such modular plastic belts are available from Intralox, LLC, of Harahan, La.

With reference to FIGS. 2 and 4, the flexible belt 72 includes a treatment portion 50 and a return portion 76. The treatment portion 50 that is defined by the portion that is passing over, or overlying the outlet opening 46, which moves from a first end 52 towards a second end 54 and which is generally bound by the upper edges 42*a*, 42*b* of the opposing walls and the terminating edges 36, 38 of the spanning wall 40. While it is shown that the treatment portion 50 of the flexible belt 72 is substantially planar and substantially horizontal, it is contemplated that the flexible belt 72 may have surface variations and that the flexible belt 72 may be inclined in either or both the direction of travel or transverse to the direction of travel. The return portion 76 is the remaining portion of the flexible belt 72 that is not overlying the outlet opening 46.

With reference to FIG. 4, a plurality of rollers 64*a*-64*g* are spaced about the outside surface 30*a*, 30*b* of the frame assembly 12, such that the return portion 76 extends about substantially the entirety of the frame assembly 12 generally following the path of the spanning wall 40 from the first terminating edge 36 to the second terminating edge 38. One of the rollers 64, namely roller 64*a* includes a sprocket 66 and is coupled to an electric motor 68 through a gear train 70. It will be understood that a user can control the electric motor 68 to vary the speed of the roller 64*a*, and in turn, the flexible belt 72.

It will be understood that in other embodiments, a flexible belt may be looped between a pair of rollers 64, wherein substantially the entirety of such a flexible belt may overlie the outlet opening 46. In other embodiments, in the place of a flexible belt, a rigid table-like structure, having a top surface, a bottom surface and a plurality of passage openings (i.e., a mesh like structure) may be utilized which can be inclined or otherwise moved to direct the product from the first terminating edge 36 to the second terminating edge 38. In still other embodiments, the rigid table may include a trap door or other structure which allows for the placement of product on the table and then removal with the aid of gravity.

The fluid supply member 16 is shown in FIG. 5 as comprising a first blower assembly 78*a* and second blower assembly 78*b*. The first blower assembly 78*a* comprises a blower fan 80*a* which is positioned within a shroud 82*a*, the outlet of which is in fluid communication with the opening 26*a* of the opposing wall 24*a*, so that air from the blower fan 80*a* is directed into the cavity 44 of the frame assembly 12. Similarly, the second blower assembly 78*b* comprises a blower fan 80*b* which is positioned within a shroud 82*b*, the outlet of which is in fluid communication with the opening 26*b* of the opposing wall 24*b*, so that air from the blower fan 80*b* is directed into the cavity 44. The two blower fans 80*a*, 80*b* direct a fluid (typically a gas, such as air) into the cavity 44 at a predetermined volume (which is based on the configuration of the blower fans as well as the operating speeds and the like). Blower fan control 88 can vary the blower speed and, as such, the volume of fluid each blower 80*a*, 80*b* generates. The fluid is then directed through the outlet opening 46 and through the passage openings of the flexible belt 72. As will be explained below, advantageously, the blower fan control can adjust the blower motors so that the pieces or parts at least one of rotate or lift off the surface of the flexible belt so as to expose a substantially greater portion of the surface into direct contact with the fluid flow.

It will be understood that the fluid that is directed by the blower fans 80*a*, 80*b* typically comprises air or purified air. In other embodiments, other gasses may be utilized such as nitrogen. In other embodiments, a cleaning vapor or liquid may be introduced into a stream of gas so as to impart a sanitizing effect upon the product (i.e., a liquid or vapor stream of hydrogen peroxide vapor or gas). In still other embodiments, larger contents of liquids or gels may be introduced into the gas stream to facilitate certain effects.

It will likewise be understood that in certain embodiments, only a single blower fan may be utilized, wherein the single fan is coupled to one of the two opposing walls (with the opening on the other wall being removed or covered over). It will likewise be understood that the present device is not limited in employing two blowers. In other embodiments, a plurality of blowers greater than two may be employed to produce the desired fluid flow, and the blower fans may be placed asymmetrically on the respective opposing walls and so as not to be directly facing each other. In other embodiments, blower fans may be set to different speeds to create variations in air flow particular to a user's specific needs. It is also likewise understood that the orientation of the blower fans does not need to be such that the flow is directed into the cavity substantially horizontally, and may instead be placed on one of the spanning walls segments instead of the opposing walls or even located at the bottom of the device and mounted so as to blow fluid substantially upward, directly at the treatment portion. In other embodiments, the fluid supply member may be located away from the frame assembly and ducted through ducts to the inlet opening In operation, the dryer apparatus may be utilized to dry product (such as blueberries) and may be placed in close association with a food processing line. It will be understood that the dryer apparatus may be used in a number of different environments, including, but not limited to parts washing, produce washing, and the like.

In such an operation, blueberries are supplied to the dryer apparatus in a condition wherein they have surface fluids (i.e., water or cleaning agents) and it is desirable to have these blueberries dried. To achieve the same, the user must first prepare the dryer apparatus to accept the blueberries.

First, the user activates the fluid supply member to provide the necessary flow of fluid into the cavity for eventual exhaust through the outlet opening and through the passage openings of the flexible belt. To dry the blueberries, filtered air is typically utilized as the fluid, although other fluids are contemplated. In the embodiment shown, the two opposing blower assemblies are activated directing filtered air into the cavity from the opposing walls.

Next, the user activates the flexible belt so that it rotates in the right direction and at the desired speed. It will be understood that different produce or small parts may require different operating speeds to achieve the desired drying action. The operator then turns on the blower fans to direct air flow through the openings in the belt. The blueberries are deposited onto the treatment portion of the belt at the first end by a previous washing station. As the belt moves, the blueberries are subject to the flow of air coming from the blowers, through the cavity, through the belt, and up and over the quantity of blueberries.

As the blueberries progress towards the second end of the flexible belt, the air flow causes the berries to jump up, bounce, rotate, and to be otherwise in motion, all the while being dried. During operation, the blueberries can lift off of the belt surface depending on the air flow, at which time they typically also rotate. This lifting and rotating contributes to the drying process by allowing air flow over the entire surface of the blueberry. The orientation of the opposing walls helps to retain and capture the blueberries from being inadvertently blown off of the flexible belt onto the floor or other equipment. It is contemplated that the blowers can be adjusted so that many of the blueberries are lifted off of the belt surface between ½ inch and even 3 to 4 inches, which is sufficient to cause rotation. Of course, the invention is not limited in this respect. As the berries transit the treatment portion and reach the second end, they have been dried and ready for subsequent processes, such as packaging.

As the flexible belt continues to rotate about the frame assembly, blueberries can be continuously placed onto the flexible belt and removed from the flexible belt for further processing. While a continuous process is disclosed, it is also contemplated that the produce (or small parts or pieces) may be batch processed, instead.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A dryer apparatus for drying a plurality of small items comprising:

a frame assembly associable with an outside structure or surface, the frame defining a cavity having an inlet and an outlet opening, the frame further including a pair of opposing walls, and a spanning wall that extends about a portion of a perimeter of the pair of opposing walls therebetween to define the cavity, a portion of which is not spanned by the opposing walls defining the outlet opening, with a wall opening defined in each one of the pair of opposing walls, the pair of opposing walls being substantially parallel to each other with the openings corresponding to each other;

a treatment member coupled to the frame, and at least a portion of which extends over the outlet opening, the treatment member having a first end and a second end, and including a treatment portion, the treatment portion having a top surface and a bottom surface opposite the top surface, and a plurality of passage openings that extend therethrough placing the top surface and the bottom surface in fluid communication, and wherein the passage openings having a size, wherein the size precludes passage of a small item therethrough, wherein the treatment member comprises a plurality of rollers rotatably coupled to the frame, and a flexible belt extending therebetween, a portion of the flexible belt having a plurality of openings defining the passage openings, extending therethrough that extends over the outlet opening defining the treatment portion of the flexible belt with a remainder of the flexible belt defining a return portion thereof, with the wall opening being positioned between the treatment portion of the flexible belt and the return portion of the flexible belt, with the treatment portion being substantially perpendicular to the pair of opposing walls, with a belt guide extending across the top surface of the treatment portion of the flexible belt, spaced apart from the opposing walls, the belt guide configured to limit vertical movement of the flexible belt during operation; and a fluid supply member associated with the inlet of the frame, the fluid supply member further comprising a first blower mounted directly to one of the wall openings and having a first shroud extending therearound substantially perpendicular to the wall opening, and, a second blower mounted directly to the other one of the wall openings and having a second shroud extending therearound substantially perpendicular to the wall opening, such that the first blower and the second blower are directly opposing each other and each direct a fluid through directly at the other and into the cavity of the frame assembly, which fluid is then directed directly onto the bottom surface of the treatment portion of the flexible belt and, in turn, through the openings of the flexible belt, with sufficient force and velocity to cause a small item positioned thereon to jump up, bounce or rotate while lifted from the flexible belt.

2. The dryer apparatus of claim 1 wherein the flexible belt comprises a plurality of substantially rigid links that are rotatably coupled together, the links configured to translate without rotating about themselves through the treatment portion.

3. The dryer apparatus of claim 1 wherein the fluid supply member further comprises a blower motor that includes a blower fan control configured to control at least a speed of the blower motor.

4. The dryer apparatus of claim 3 wherein the blower fan control allows the blower motor speed to be adjustable.

5. A method of drying small parts or pieces comprising the steps of:

providing a frame assembly having an outlet opening, with a fluid supply member directing fluid at the outlet opening, the frame further including a pair of opposing walls, and a spanning wall that extends about a portion of a perimeter of the pair of opposing walls therebetween to define the cavity, a portion of which is not spanned by the opposing walls defining the outlet opening, with a wall opening defined one of the pair of opposing walls;

placing a treatment member having a top surface, a bottom surface and a plurality of openings extending therethrough in operable orientation with the outlet opening to, in turn, direct fluid through the plurality of openings of the treatment table, wherein the treatment member comprises a plurality of rollers rotatably coupled to the frame, and a flexible belt extending therebetween, a portion of the flexible belt having a plurality of openings defining the passage openings, extending therethrough that extends over the outlet opening defining the treatment portion of the flexible belt with a remainder of the flexible belt defining a return portion thereof, with the wall opening being positioned between the treatment portion of the flexible belt and the return portion of the flexible belt;

positioning a belt guide across the top surface of the flexible belt, thereby limiting vertical movement of the belt;

activating the fluid supply member to direct a fluid through the outlet opening to the plurality of openings of the treatment member, the fluid supply member further comprising a first blower coupled directly to the wall opening of one of the pair of opposing walls, and a second blower coupled directly to the wall opening of the other one of the pair of opposing walls, wherein the first blower and the second blower directly oppose each other and direct a fluid through the respective wall opening directly toward each other and into the cavity of the frame assembly and, in turn, directly onto the bottom surface of the treatment portion of the flexible belt and, in turn, through the openings of the flexible belt;

placing a plurality of small pieces or parts on the top surface of the treatment member;

controlling the fluid supply member to provide sufficient fluid through the plurality of openings of the treatment member to effectuate at least one of lifting off of at least some of the pieces or parts on the top surface of the treatment member and rolling of at least some of the pieces or parts on the top surface of the treatment member.

6. The method of claim 5 further comprising wherein the treatment member comprises a flexible belt having a treatment portion that extends over the outlet opening, and a plurality of rollers configured around the frame to guide the flexible belt therearound, the method further comprising the steps of:

activating at least one of the plurality of rollers to move the flexible belt along the outlet opening.

7. The method of claim 5, wherein the pieces or parts lift off the surface between ½ inch and 4 inches.

8. The dryer apparatus of claim 1 wherein the first and second blowers include an axis of rotation that is perpendicular to the opposing walls.

9. The dryer apparatus of claim 8 wherein the axis of rotation of the first and second blowers are collinear.

* * * * *